US011370464B2

(12) United States Patent
Li et al.

(10) Patent No.: US 11,370,464 B2
(45) Date of Patent: Jun. 28, 2022

(54) FOLDING CANOPY MAIN BODY, FOLDING CANOPY ASSEMBLY AND TRAIN IHROUGH PASSAGE

(71) Applicant: BYD COMPANY LIMITED, Shenzhen (CN)

(72) Inventors: Weiwei Li, Shenzhen (CN); Yanhua Chen, Shenzhen (CN); Haonan Du, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 384 days.

(21) Appl. No.: 16/475,360

(22) PCT Filed: May 31, 2017

(86) PCT No.: PCT/CN2017/086707
§ 371 (c)(1),
(2) Date: Jul. 1, 2019

(87) PCT Pub. No.: WO2018/120648
PCT Pub. Date: Jul. 5, 2018

(65) Prior Publication Data

US 2019/0308644 A1 Oct. 10, 2019

(30) Foreign Application Priority Data

Dec. 30, 2016 (CN) ..... 201611261179.1

(51) Int. Cl.
*B61D 17/20* (2006.01)
*B61D 17/22* (2006.01)

(52) U.S. Cl.
CPC ..... *B61D 17/22* (2013.01); *B61D 17/20* (2013.01)

(58) Field of Classification Search
CPC ..... B60D 5/003; B60D 5/006; B61D 17/22; B61D 17/20
See application file for complete search history.

(56) References Cited

U.S. PATENT DOCUMENTS 758,697 A * 5/1904 Salisbury ..... B61D 17/22 105/18
6,443,070 B1 * 9/2002 Mauberger ..... B61D 17/20 105/3

FOREIGN PATENT DOCUMENTS

CN 2866277 Y 2/2007
CN 101323308 A 12/2008
(Continued)

OTHER PUBLICATIONS

The World Intellectual Property Organization (WIPO) International Search Report for PCT/CN2017/086707 dated Oct. 11, 2017 6 Pages.

*Primary Examiner* — Mark T Le
(74) *Attorney, Agent, or Firm* — Anova Law Group, PLLC

(57) ABSTRACT

A folding-canopy main body used for a train through-passage includes an outward folding-canopy body and an inward folding-canopy body. The folding-canopy main body is vertically provided and extends along a front-back direction. The inward folding-canopy body is formed by connecting at least two pieces of internal canopy cloth which arch inwards to form a U shape along the front-back direction, the outward folding-canopy body is formed by connecting at least two pieces of external canopy cloth which arch outwards to form a U shape along the front-back direction, and the end portions of two adjacent pieces of internal canopy cloth and the end, portions of two adjacent pieces of external canopy cloth are all clamped and riveted by U-shaped parts.

11 Claims, 7 Drawing Sheets

(56) References Cited

FOREIGN PATENT DOCUMENTS

| | | | | |
|---|---|---|---|---|
| CN | 201544968 | U | | 8/2010 |
| CN | 101844565 | A | | 9/2010 |
| CN | 201712617 | U | | 1/2011 |
| CN | 102180177 | A | | 9/2011 |
| CN | 201961323 | U | | 9/2011 |
| CN | 202574233 | U | | 12/2012 |
| CN | 203419142 | U | | 2/2014 |
| CN | 103625488 | A | | 3/2014 |
| CN | 103921803 | A | | 7/2014 |
| CN | 203713445 | U | | 7/2014 |
| EP | 0329031 | A1 | | 8/1989 |
| EP | 1810852 | A1 | | 7/2007 |
| JP | 2006176011 | A | | 7/2006 |
| JP | 2006240349 | A | | 9/2006 |
| KR | 200330829 | Y1 | * | 10/2003 |
| KR | 100875526 | B1 | | 12/2008 |
| KR | 20100042300 | A | * | 4/2010 |

* cited by examiner

FOLDING CANOPY MAIN BODY, FOLDING CANOPY ASSEMBLY AND TRAIN IHROUGH PASSAGE

CROSS-REFERENCE TO RELATED APPLICATIONS

This application is a national phase entry under 35 U.S.C. § 371 of International Application No. PCT/CN2017/086707, filed on May 31, 2017, which claims a priority to and benefits of Chinese Patent Application Serial No. 201611261179.1, filed on Dec. 30, 2016, the entire content of all of which is incorporated herein by reference.

FIELD

The present invention relates to the technical field of vehicles, in particular to a folding canopy main body used for a train through passage, a folding canopy assembly with the folding canopy main body and used for the train through passage, and the train through passage with the folding canopy assembly.

BACKGROUND

In related art, tooth groove design is adopted for the part of a folding-canopy frame. Although the effect of enhancing connection of canopy cloth is achieved, the requirement for processing is increased, and meanwhile, the requirement for the strength of a folding-canopy frame is correspondingly increased. A vehicle end wall frame simultaneously plays the roles of connecting a vehicle end and fixing the canopy cloth, and mounting and dismounting of the through-passage are relatively troublesome. A cab apron locking mechanism locks a linkage lock pin in a locking mechanism by a bolt in the mechanism, the structure is relatively complicated, and the maintenance is relatively troublesome.

SUMMARY

An objective of the present disclosure is to at least resolve one of the technical problems in the related art to some extent. Therefore, in the first aspect, the present disclosure provides a folding-canopy main body used for a train through-passage, and the assembling of the folding-canopy main body is convenient.

In the second aspect, the present disclosure provides a folding-canopy assembly including the folding-canopy main body and used for the train through-passage.

In the third aspect, the present disclosure provides a train through-passage including the folding-canopy assembly.

For the folding-canopy main body used for a train through-passage according to the embodiment of the first aspect of the present disclosure, the folding-canopy main body is vertically provided and extends along the front-back direction, the folding-canopy main body includes an outward folding-canopy body and an inward folding-canopy body, the inward folding-canopy body is formed by connecting at least two pieces of internal canopy cloth which arch inwards to form a U shape along the front-back direction, the outward folding-canopy body is formed by connecting at least two pieces of external canopy cloth which arch outwards to form a U shape along the front-back direction, and the end portions of two adjacent pieces of internal canopy cloth and the end portions of two adjacent pieces of external canopy cloth are all clamped and riveted by U-shaped parts.

The folding-canopy main body used for the train through-passage according to the embodiment of the present disclosure is convenient to assemble, the assembling and mounting efficiency of the folding-canopy main body can be increased, and the structure strength of the folding-canopy main body can be improved.

A folding-canopy assembly used for a train through-passage according to the embodiment of the second aspect of the present disclosure includes a vehicle frame, where the vehicle frame is mounted on a vehicle end wall; a folding-canopy main body, where the folding-canopy main body is the above-mentioned folding-canopy main body used for the train through-passage, the front side and the rear side of the folding-canopy main body are both connected with a folding-canopy mounting frame, the folding-canopy mounting frames are detachably connected with the vehicle frame; and a locking mechanism, where the locking mechanism is fixedly mounted on the vehicle frame, and used for locking the folding-canopy mounting frames and the vehicle frame together or releasing the folding-canopy mounting frames from the vehicle frame, and the locking mechanism is switched between a locking state and a releasing state.

For the folding-canopy assembly used for the train through-passage according to the embodiment of the present disclosure, the locking mechanism is provided to realize rapid connection of the folding-canopy mounting frames with the vehicle frame. Moreover, when the folding-canopy main body is dismounted and changed, the folding-canopy main body is rapidly dismounted by the locking mechanism, so as to increase the mounting and dismounting efficiency of the folding-canopy assembly.

Moreover, the folding-canopy assembly used for the train through-passage according to the above-mentioned embodiment of the present disclosure also has the following additional technical characteristics:

In an embodiment of the present disclosure, the vehicle frame includes a frame body, and at least one portion of the folding-canopy mounting frame extends into the frame body of the vehicle frame and is suitable for being pressed by the locking mechanism.

In an embodiment of the present disclosure, the locking mechanism includes: a mounting bracket, where the mounting bracket is fixedly mounted on the vehicle body; a bolt, where the bolt is rotatably provided on the mounting bracket and between the position for locking the folding-canopy mounting frames and the position for releasing the folding-canopy mounting frames; and a limiting part, where the limiting part is suitable for limiting the bolt when the bolt locks the folding-canopy mounting frames.

In an embodiment of the present disclosure, a rubber mat is provided between the folding-canopy mounting frames and the vehicle frame.

In an embodiment of the present disclosure, the folding-canopy main body is riveted with the folding-canopy mounting frames.

In the third aspect, the present disclosure provides the train through-passage, including two folding-canopy assemblies, where the two folding-canopy assemblies are deployed in bilateral symmetry, and the two folding-canopy assemblies are the above-mentioned folding-canopy assembly used for the train through-passage; and a cab apron assembly, where the cab apron assembly is horizontally deployed below the folding-canopy assemblies to form a passage located between the two folding-canopy assemblies.

The assembling efficiency, stability and safety are increased according to the train through-passage of the embodiment of the present disclosure.

In an embodiment of the present disclosure, the cab apron assembly includes: a cab apron body, where the cab apron body is horizontally provided; two pedals, respectively provided at the front side and the rear side of the cab apron body, where the pedals are used for connecting the vehicle ends of carriages and supporting the cab apron body; and a linkage assembly, used for connecting two adjacent carriages, where the linkage assembly is deployed along the front-back direction, the front end and the rear end of the linkage assembly are suitable for connecting the vehicle ends of the carriages, and a positioning mechanism connected with the cab apron body is provided on the linkage assembly.

In an embodiment of the present disclosure, the pedal includes: a pedal first leaf, where the pedal first leaf is horizontally provided and supported below the side edge of the cab apron body, and the pedal first leaf is located at the outer side of the side edge of the cab apron body; and a pedal second leaf, where the pedal second leaf is horizontally provided and supported below the side edge of the cab apron body, and the pedal second leaf is movably connected with the pedal first leaf.

Further, the pedal first leaf is connected with the pedal second leaf by a hinge.

In an embodiment of the present disclosure, the train through-passage also includes: pedal supports, where the pedal supports are used for connecting the vehicle ends of the carriages, the front end of the linkage assembly and the pedal located at the front side are connected with the pedal support located at the front side, and the rear end of the linkage assembly and the pedal located at the rear side are connected with the pedal support located at the rear side.

In an embodiment of the present disclosure, cab apron abrasion bars are provided below the front end and the rear end of the cab apron body, which is supported on the pedals by the cab apron abrasion bars.

In an embodiment of the present disclosure, the positioning mechanism includes: a cab apron cover locking plate, where the cab apron cover locking plate is connected with the cab apron body; a linkage positioning plate, where the linkage positioning plate is connected with the cab apron cover locking plate; and a cab apron positioning pin, where the cab apron positioning pin is connected with the linkage positioning plate and a linkage respectively.

Further, the upper end of the cab apron positioning pin penetrates through the linkage positioning plate and is locked by a cab apron positioning pin locking plate.

Preferably, the positioning mechanism also includes a cab apron cover, a mounting hole is formed in the cab apron body, the cab apron cover is provided in the mounting hole, the cab apron cover is fixedly connected with the cab apron cover locking plate, and the upper surface of the cab apron cover is flush with the upper surface of the cab apron body.

Preferably, the cab apron cover locking plate is connected with the cab apron cover by a screw.

In an embodiment of the present disclosure, the train through-passage also includes a support device used for being mounted on a vehicle coupler, and the support device includes: a bottom plate, where the bottom plate is used for being mounted on the vehicle coupler; a support frame, where the lower end of the support frame is provided with a wear resisting block and is movably supported on the bottom plate; and wear resisting plates, where the wear resisting plates are provided on the bottom plate and used to limit the support frame along the front-back direction, and the lower end of at least one U-shaped part in the folding-canopy main body is supported on the support frame.

Further, two wear-resisting plates are deployed in the front and at the behind at an interval, the opposite side edges of the two wear-resisting plates are of arc shapes bulging towards opposite directions, and the wear-resisting block extends along the left-right direction and is movably provided between the two wear-resisting plates.

Figure 1:
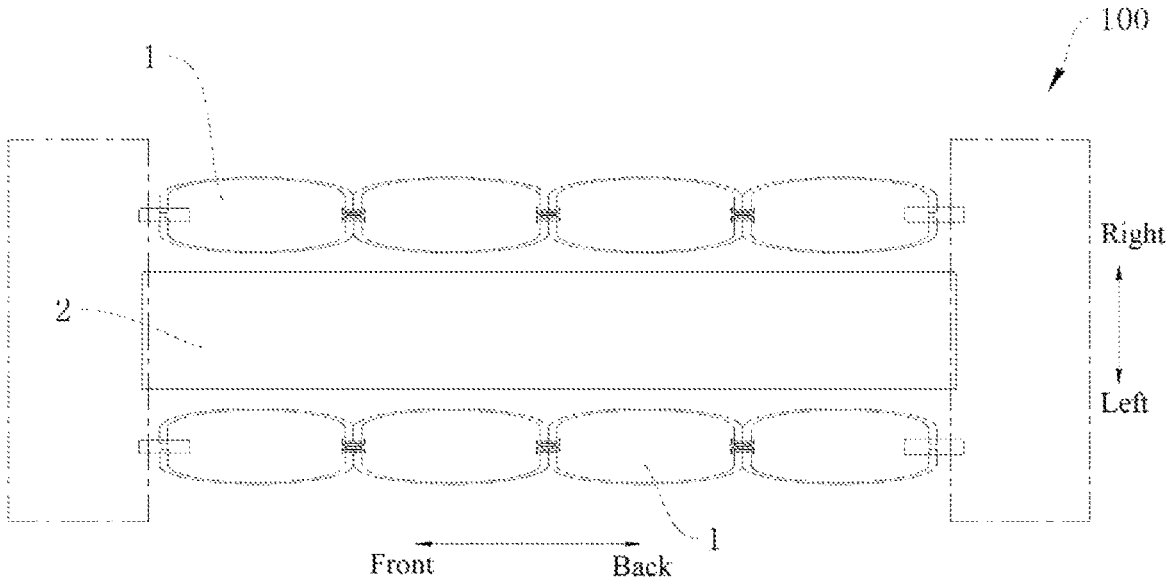
FIG. 1 is a schematic diagram of a train through-passage in one embodiment of the present disclosure.

Reference numerals in the drawings: train through-passage 100, folding-canopy assembly 1, folding-canopy main body 11, outward folding-canopy body 111, external canopy cloth 1111, inward folding-canopy body 112, internal canopy cloth 1121, U-shaped part 113, folding-canopy mounting frame 114, vehicle frame 12, counterbore 1201, locking mechanism 13, mounting bracket 131, bolt 132, positioning slot 1321, guiding wedge-shaped portion 1322, limiting part 133, locking bolt 134, rubber mat 14, support device 15, bottom plate 151, support frame 152, wear-resisting plate 153, wear-resisting block 154, cab apron assembly 2, cab apron body 21, cab apron abrasion bar 211, pedal 22, pedal first leaf 221, pedal second leaf 222, hinge 223, linkage assembly 23, positioning mechanism 24, cab apron cover locking plate 241, cab apron positioning pin 243, cab apron positioning pin locking plate 244, cab apron cover 245, pedal support 25.

DETAILED DESCRIPTION

The following describes in detail embodiments of the present disclosure. Examples of the embodiments are shown in the accompanying drawings, where reference signs that are the same or similar from beginning to end represent same or similar components or components that have same or similar functions. The following embodiments described with reference to the accompanying drawings are exemplary, and are intended to describe the present disclosure and cannot be construed as a limitation to the present disclosure.

As shown in FIG. 1, a train through-passage 100 is used for communicating two carriages, and forming a communicating passage between two carriages, a common train through-passage 100 includes: a folding-canopy assembly, a cab apron assembly and the like, where the folding-canopy assembly includes a folding-canopy main body. The folding-canopy assembly 1, the folding-canopy main body 11 and the cab apron assembly 2 of specific embodiments of the present disclosure will be described in combination with the drawings as below. The folding-canopy assembly 1, the folding-canopy main body 11 and the cab apron assembly 2 are combined to form the train through-passage 100, and are also respectively applied to different train through-passages 100.

Detailed description will be made to the folding-canopy main body 11 used for the train through-passage 100 in combination with the drawings as below.

Figure 2:
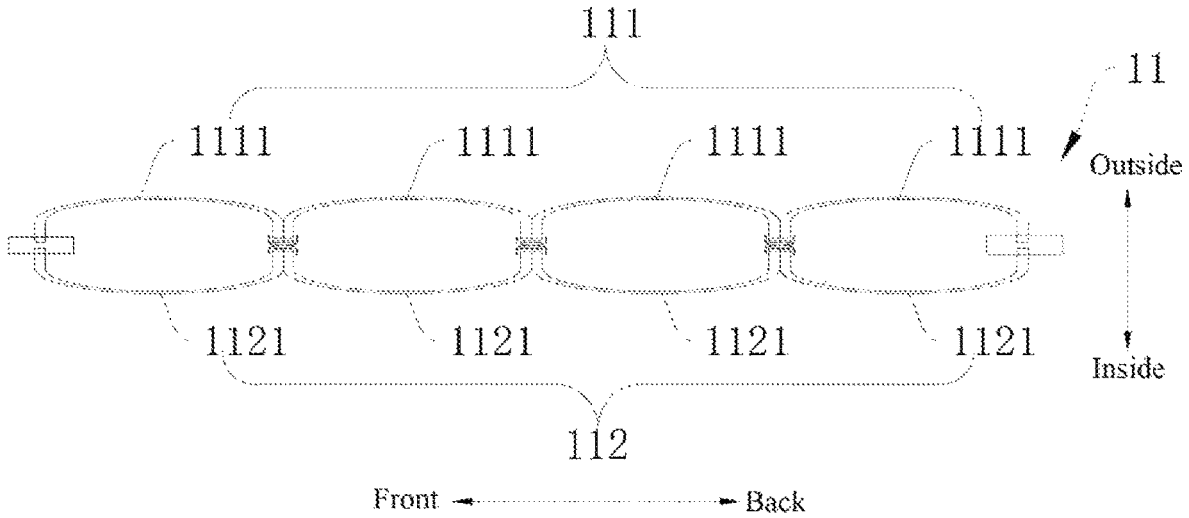
FIG. 2 is a schematic diagram of a folding-canopy main body in one embodiment of the present disclosure.

As shown in FIG. 2, for the folding-canopy main body 11 used for the train through-passage 100 according to the embodiment of the present disclosure, the folding-canopy main body is vertically provided and extends along the front-back direction, the folding-canopy main body 11 includes an outward folding-canopy body 111 and an inward folding-canopy body 112, the inward folding-canopy body 112 is formed by connecting at least two pieces of internal canopy cloth 1121 which arch inwards to form a U shape along the front-back direction, the outward folding-canopy body 111 is formed by connecting at least two pieces of external canopy cloth 1111 which arch outwards to form a U shape along the front-back direction, and the end portions of two adjacent pieces of internal canopy cloth 1121 and the end portions of two adjacent pieces of external canopy cloth 1111 are all clamped and riveted by U-shaped parts.

For the folding-canopy main body 11 used for the train through-passage 100 according to the embodiment of the present disclosure, the end portions of two adjacent pieces of internal canopy cloth 1121 are clamped by a U-shaped part 113 to realize connection of the adjacent pieces of internal canopy cloth 1121, so as to form the inward folding-canopy body 112, the end portions of two adjacent pieces of external canopy cloth 1111 are clamped by the U-shaped part 113 to realize connection of the adjacent pieces of external canopy cloth 1111, so as to form the outward folding-canopy body 111. The forming manners of the inward folding-canopy body 112 and the outward folding-canopy body 111 are simple, the assembly is convenient, the assembling and mounting efficiency of the folding-canopy main body 11 can be increased, and furthermore, the structure strength of the folding-canopy main body 11 can be improved.

Moreover, the riveting manner is adopted to realize steady connection between adjacent pieces of internal canopy cloth 1121 and adjacent pieces of external canopy cloth 1111, so as to improve the structure strength of the folding-canopy main body 11.

Further, the inner side of the U-shaped part 113 of the present disclosure does not have a sawtooth structure. Preferably, the inner surface and the outer surface of the U-shaped part 113 are both smooth surfaces, so that the forming of the U-shaped part 113 is easy, and the making efficiency of the folding-canopy main body 11 is increased. Further preferably, the U-shaped part 113 is formed by bending a slab.

Figure 3:
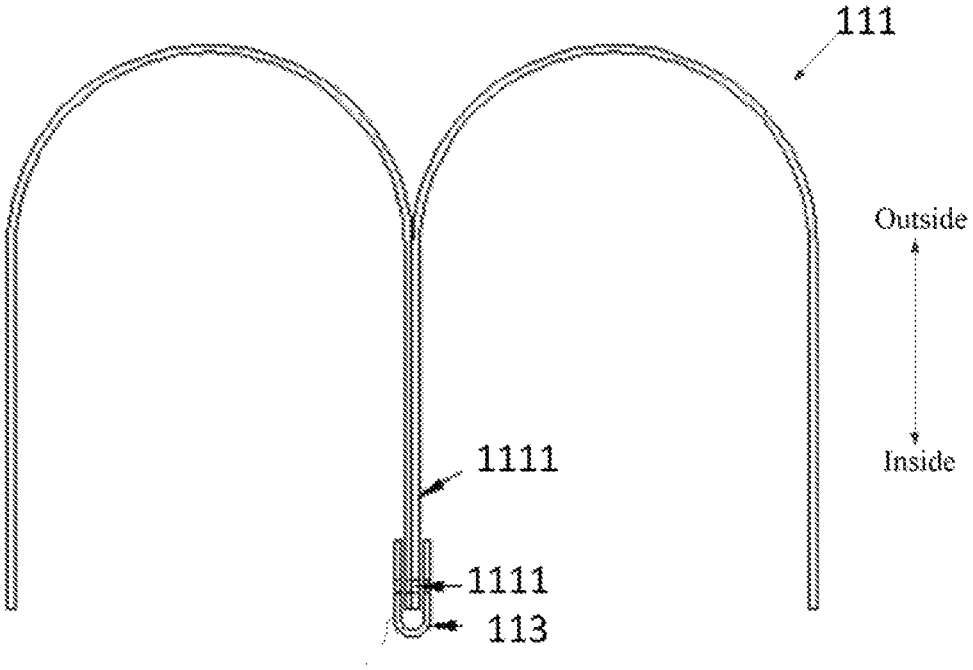
FIG. 3 is a schematic diagram of a connecting structure of adjacent pieces of external canopy cloth of the folding-canopy main body in one embodiment of the present disclosure.

A person skilled in the art may understand that, FIG. 3 shows a connecting structure between two adjacent pieces of external canopy cloth 1111. The inward folding-canopy body 112 and the outward folding-canopy body 111 are symmetric to each other, that is, two adjacent pieces of internal canopy cloth 1121 have a connecting structure the same as that as shown in FIG. 3.

In the second aspect, the present disclosure provides a folding-canopy assembly 1 used for the train through-passage 100.

In combination with FIG. 2 to FIG. 7, the folding-canopy assembly 1 used for the train through-passage 100 according to the embodiment of the present disclosure includes: a vehicle frame 12, a folding-canopy main body 11 and a locking mechanism 13.

Specifically, the vehicle frame 12 is mounted on a vehicle end wall. The folding-canopy main body is vertically provided and extends along the front-back direction, the front side and the rear side of the folding-canopy main body 11 are both connected with a folding-canopy mounting frame 114, and the folding-canopy mounting frames 114 are detachably connected with the vehicle frame 12. The locking mechanism 13 is fixedly mounted on the vehicle frame 12, is used for locking the folding-canopy mounting frames 114 and the vehicle frame 12 together or releasing the folding-canopy mounting frames 114 from the vehicle frame 12, and is switched between a locking state and a releasing state.

For the folding-canopy assembly 1 according to the embodiment of the present disclosure, the arrangement of the locking mechanism realizes rapid connection of the folding-canopy mounting frames 114 and the vehicle frame 12. Moreover, when the folding-canopy main body 11 needs to be dismounted and changed, the folding-canopy main body 11 is rapidly dismounted by the locking mechanism, so as to increase the mounting and dismounting efficiency of the folding-canopy assembly 1.

When the folding-canopy assembly 1 is mounted, firstly, the walls of the vehicle ends of two adjacent carriages are both fixedly connected with the vehicle frames 12, then the front end and the rear end of the folding-canopy main body 11 are respectively connected to the vehicle frames 12 of the two adjacent carriages, and in dismounting, only the state of the locking mechanism needs to be switched, so as to rapidly dismount the folding-canopy main body 11 from the vehicle frames 12.

Moreover, the folding-canopy main body 11 is the folding-canopy main body used for the train through-passage described in the above-mentioned embodiment.

Figure 4:
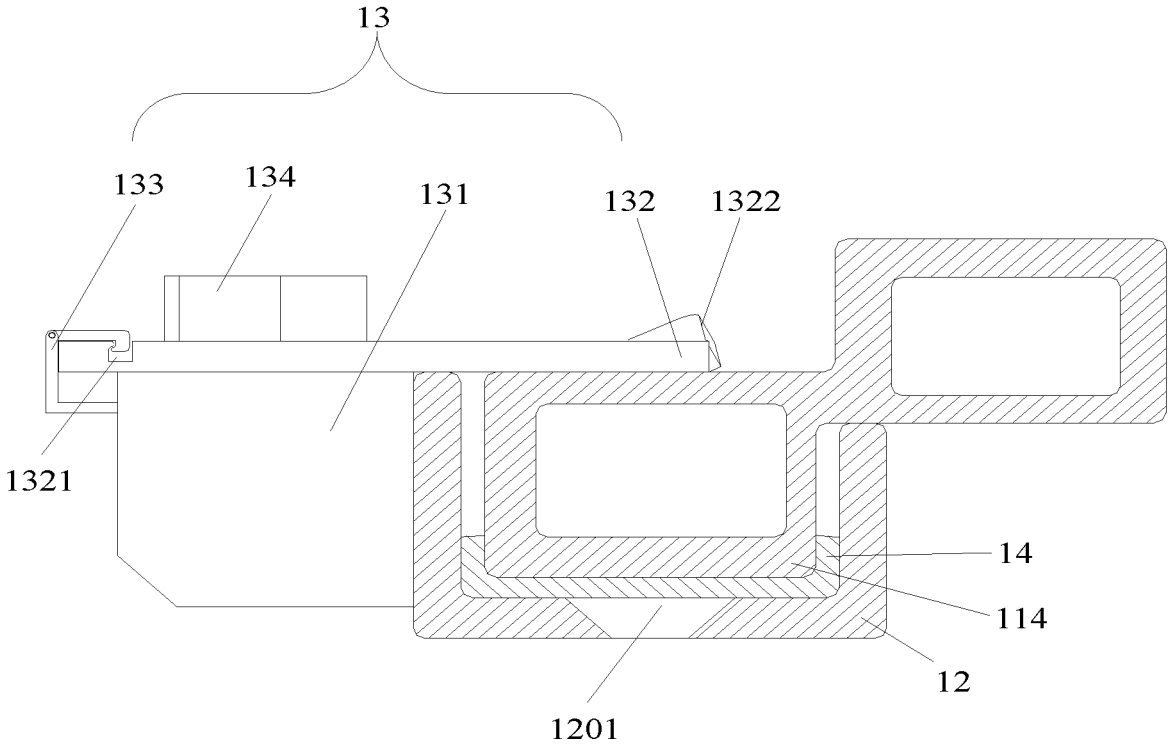
FIG. 4 is a schematic diagram of an assembling structure of folding-canopy mounting frames, a vehicle frame and a locking mechanism in one embodiment of the present disclosure.

As shown in FIG. 4, in some embodiments of the present disclosure, at least one portion of the folding-canopy mounting frame 114 extends into the vehicle frame 12 and is suitable for being pressed by the locking mechanism 13.

For example, the vehicle frame 12 includes a frame body, one portion of the folding-canopy mounting frame 114 extends into the frame body of the vehicle frame 12, and then the locking mechanism 13 seals and covers one end of the frame body and presses the folding-canopy mounting frame 114. Moreover, one end of the frame body is also sealed by a cover plate, so as to be convenient for mounting the vehicle frame 12 on a vehicle body.

In the assembling process of the folding-canopy assembly 1, at least one portion of the folding-canopy mounting frame 114 is placed in the vehicle frame 12 with one side open. And then the locking mechanism 13 covers the open side of the vehicle frame 12, so as to realize the steady mounting of the folding-canopy mounting frame 114 and the vehicle frame 12. On the contrary, when the folding-canopy main body is dismounted, the state of the locking mechanism 13 is switched to eliminate the sealing and covering of the locking mechanism 13 to the open section of the vehicle frame 12. The folding-canopy mounting frame 114 is taken out to complete dismounting of the folding-canopy main body 11.

By setting the vehicle frame 12 into a shape with one side open, steady matching and rapid assembling of the folding-canopy mounting frames 114 and the vehicle frame 12 are realized, so that the assembling efficiency and the assembling stability of the folding-canopy assembly 1 are effectively improved.

In combination with FIG. 4 to FIG. 7, the locking mechanism 13 includes: a mounting bracket 131, a bolt 132 and a limiting part 133. The mounting bracket 131 is fixedly mounted on the vehicle frame 12. The bolt 132 is rotatably provided on the mounting bracket 131 and between the position for locking the folding-canopy mounting frames 114 and the position for releasing the folding-canopy mounting frames 114. The limiting part 133 is suitable for limiting the bolt 132 when the bolt 132 locks the folding-canopy mounting frames 114.

The locking mechanism 13 is simple in structure, and capable of conveniently and rapidly locking and releasing the folding-canopy mounting frames 114, so as to increase the assembling and dismounting efficiency. Moreover, the arrangement of the limiting part 133 enables the folding-canopy mounting frames 114 to stably keep the locked state, so as to improve the stability of the folding-canopy assembly.

Moreover, the position of the bolt 132 is retained by friction force between the bolt 132 and the folding-canopy mounting frames 114 without setting the limiting part 133.

Figure 6:
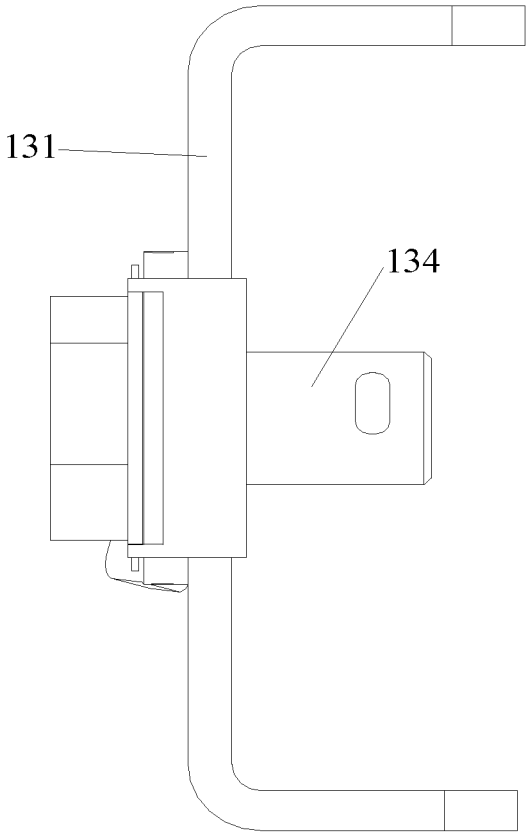
FIG. 6 is a schematic diagram of the locking mechanism in FIG. 4.

Further, as shown in FIG. 6, the mounting bracket 131 is of a U shape with the opening facing the vehicle frame 12, the mounting bracket 131 and the vehicle body 12 are connected in a welded manner or by screws, and the bolt 132 is rotatably connected to the sealed end of the mounting bracket 131, so as to realize steady mounting of the mounting bracket 131.

Further, as shown in FIG. 4, the limiting part 133 is provided on the mounting bracket 131, a positioning slot 1321 is formed in the bolt 132, and the end portion of the limiting part 133 is inserted into the positioning slot 1321 when the bolt 132 locks the folding-canopy mounting frames 114, so as to realize steady positioning of the bolt 132.

In combination with FIG. 4 to FIG. 7, in some embodiments of the present disclosure, the locking mechanism 13 also includes: a locking bolt 134, the rod portion of the locking bolt 134 runs through the bolt 132 and the mounting bracket 131 and is connected with a positioning pin, and the bolt 132 and the locking bolt 134 rotate oppositely. The steady mounting and rotating of the bolt 132 is realized by the locking bolt 134.

Figure 7:
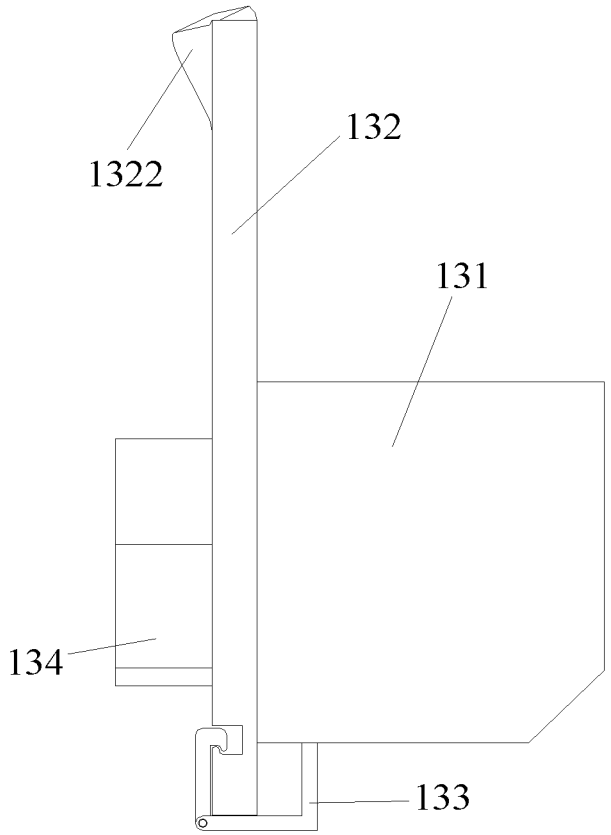
FIG. 7 is a top view of FIG. 6.

As shown in FIG. 4 and FIG. 7, the side edge of the free end of the bolt 132 bends towards a direction away from the vehicle frame 12 to form a guiding wedge-shaped portion 1322. In the process that the bolt 132 rotates to lock the folding-canopy mounting frame 114, the guiding wedge-shaped portion 1322 will cause the bolt 132 to rotate more smoothly, so as to achieve the purpose of compressing the folding-canopy mounting frames 114 by the bolt 132, and then the assembling efficiency of the folding-canopy assembly 1 is increased.

Figure 5:
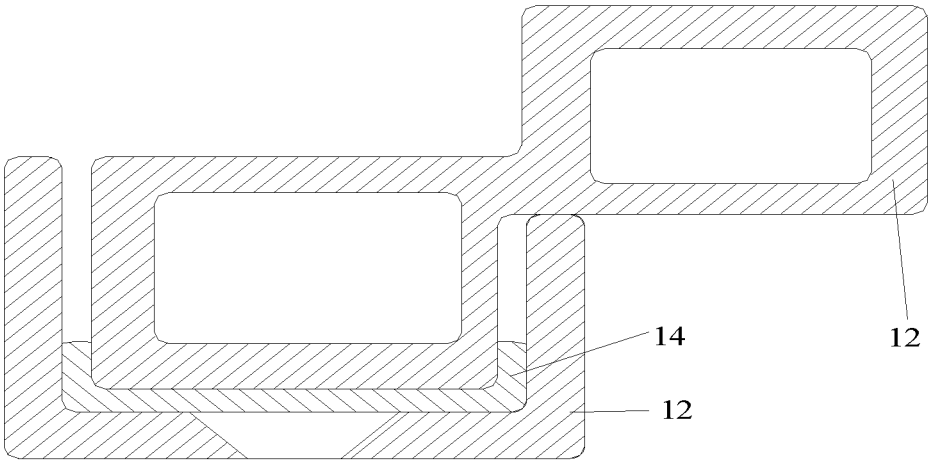
FIG. 5 is a schematic diagram of the assembling structure of the folding-canopy mounting frames and the vehicle frame in FIG. 4.

As shown in FIG. 4 and FIG. 5, in some embodiments of the present disclosure, a rubber mat 14 is provided between the folding-canopy mounting frame 114 and the vehicle frame 12. The rubber mat 14 is compressed between the folding-canopy mounting frame 114 and the vehicle frame 12. And by the elastic effect of the rubber mat 14, the mounting stability and the structure strength of the folding-canopy mounting frame 114 is further improved.

Further, as shown in FIG. 4, a counterbore 1201 used for being connected with the vehicle end wall by screws is formed in the vehicle frame 12. The vehicle frame 12 is fixed on the vehicle end wall by sunk screws, and the space utilization rate is increased.

Figure 8:
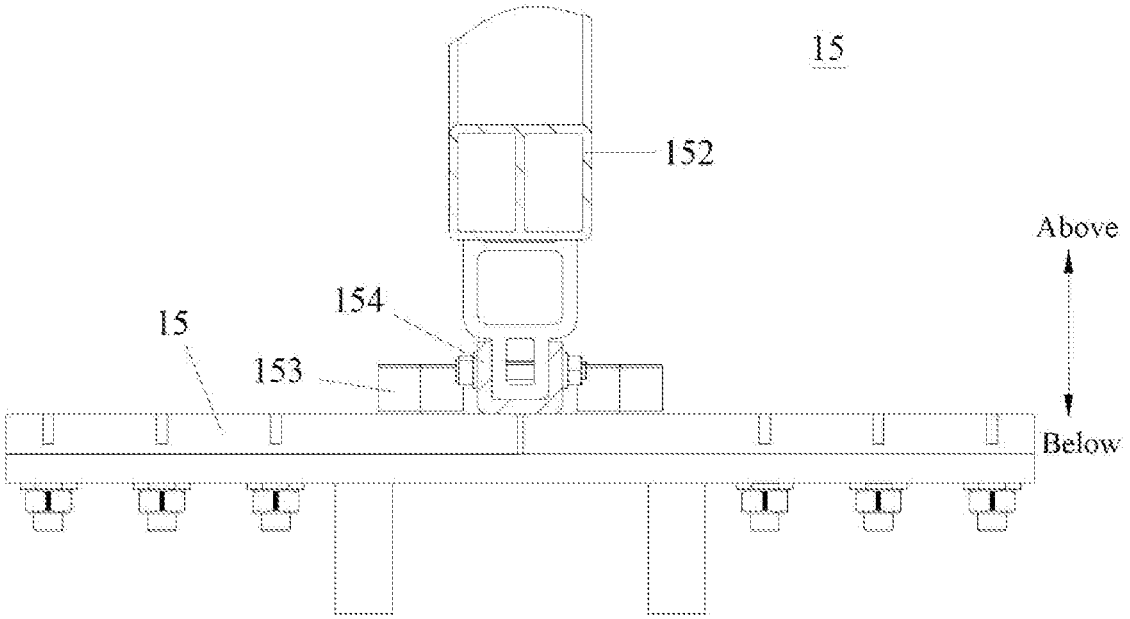
FIG. 8 is a schematic diagram of a support device in an embodiment of the present disclosure.
Figure 9:
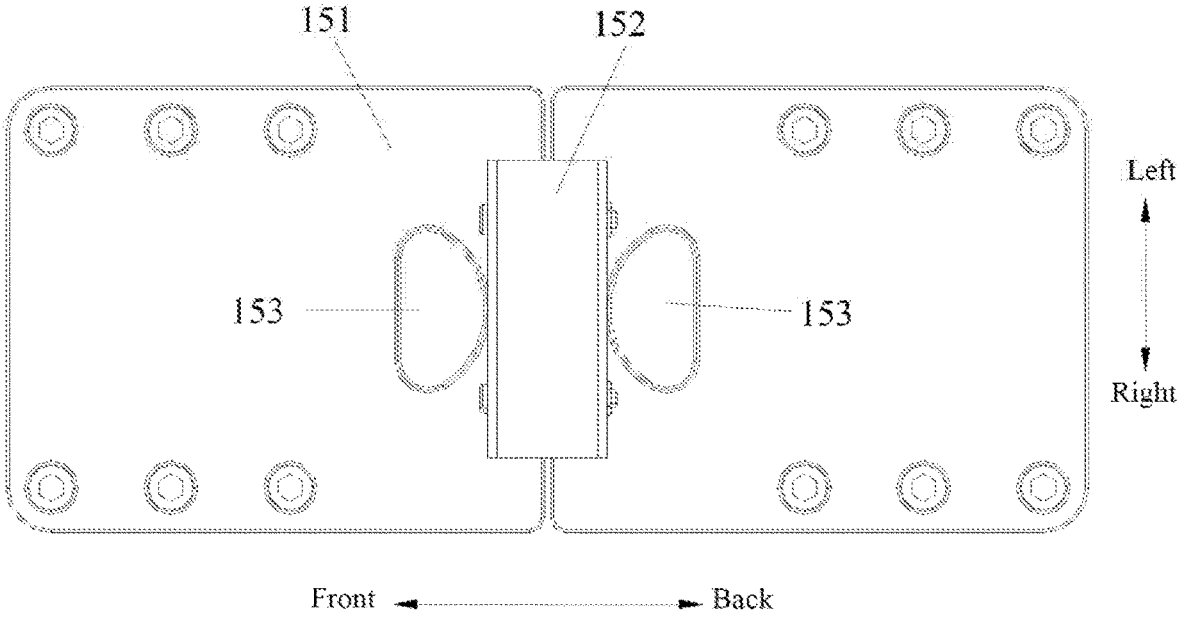
FIG. 9 is a stop view of FIG. 8.

In combination with FIG. 8 and FIG. 9, the train through-passage 100 according to the embodiment of the present disclosure also includes a support device 15 used for being mounted on a vehicle coupler, and the support device 15 includes: a bottom plate 151, a support frame 152 and wear-resisting plates 153.

Specifically, the bottom plate 151 is used for being mounted on the vehicle coupler; the lower end of the support frame 152 is provided with a wear-resisting block 154 and movably supported on the bottom plate 151; the wear-resisting plates 153 are provided on the bottom plate 151 and used to limit the support frame 152 along the front-back direction, where the lower end of at least one U-shaped part 113 in the folding-canopy main body 11 is supported on the support frame 152.

Support to the folding-canopy main body 11 is realized by the support device 15, so that the structure of the folding-canopy assembly 1 is steady. Moreover, wear-resisting parts are supported on the bottom plate 151, and in the moving process of the support frame 152, the wear-resisting parts improve the wear-resisting property of the support frame 152.

Further, as shown in FIG. 9, two wear-resisting plates 153 are deployed along the front-back direction at an interval, and the opposite side edges of the two wear-resisting plates in the front-back direction are of arc shapes bulging towards opposite directions. And the wear-resisting block 154 extends along the left-right direction and is movably provided between the two wear-resisting plates 153. The support frame 152 is steadily positioned by the two wear-resisting plates 153, and the movement of the support frame 152 cannot be limited, so as to improve the stability and flexibility of the folding-canopy main body 11.

Further, the folding-canopy main body 11 is riveted with the folding-canopy mounting frames 114.

The present disclosure also provides a cab apron assembly 2 for the train through-passage 100.

In combination with FIG. 10 to FIG. 13, the cab apron assembly 2 for the train through-passage 100 according to the embodiment of the present disclosure includes: a cab apron body 21, two pedals 22 and a linkage assembly 23. The cab apron body 21 is horizontally provided; the two pedals 22 are respectively provided at the front side and the rear side of the cab apron body 21, and the pedals 22 are used for connecting the vehicle ends of carriages and supporting the cab apron body 21; the linkage assembly 23 is used for connecting two adjacent carriages, and is deployed along the front-back direction, the front end and the rear end of the linkage assembly 23 are suitable for connecting the vehicle ends of the carriages, and a positioning mechanism 24 connected with the cab apron body 21 is provided on the linkage assembly 23.

A steady passage is formed for the cab apron assembly 2 for the train through-passage 100 according to the embodiment of the present disclosure, and two carriages may realize relative movement flexibly, so that the train is capable of running stably.

Figure 10:
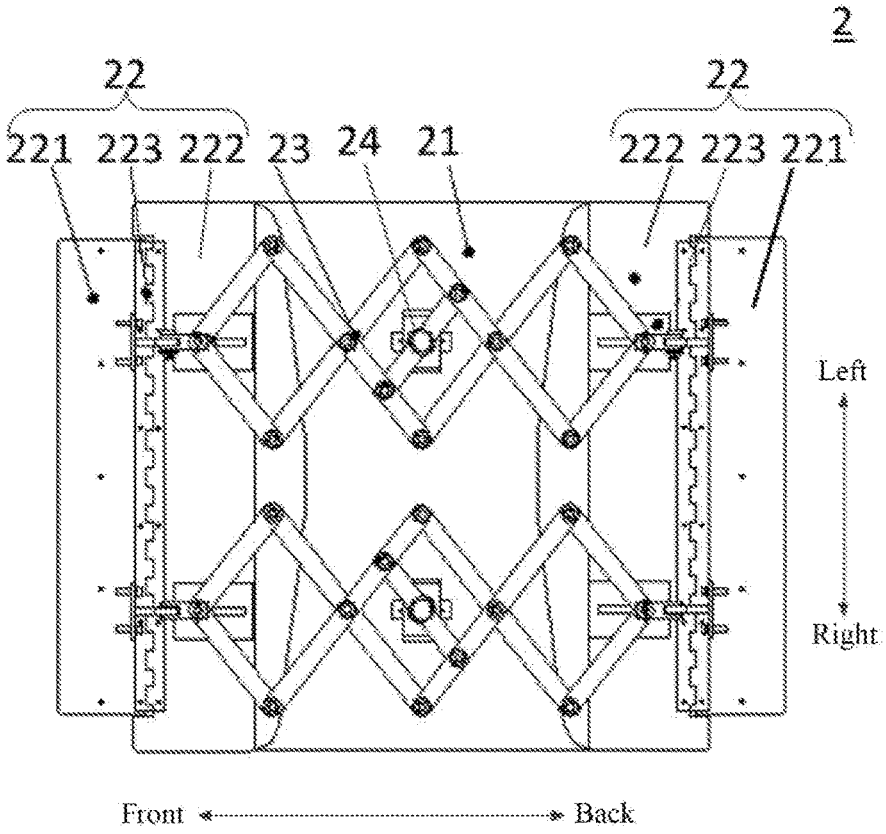
FIG. 10 is an upward view of a cab apron assembly in an embodiment of the present disclosure.

As shown in FIG. 10, in some embodiments of the present disclosure, the pedal 22 includes: a pedal first leaf 221 and a pedal second leaf 222. The pedal first leaf 221 and the pedal second leaf 222 are horizontally provided and supported below the side edge of the cab apron body 21; the pedal second leaf 222 is movably connected with the pedal first leaf 221, and the pedal first leaf 221 is located at the outer side of the side edge of the cab apron body 21. The pedal first leaf 221 is movably connected with the pedal second leaf 222, so that the cab apron assembly 2 is capable of moving to achieve the purpose of reducing vibration. Moreover, when the train makes a turn, and two carriages are not on the same straight line, the steady running of the train is realized due to the movable front and back leaves of the pedal 22.

Further, as shown in FIG. 10, the pedal first leaf 221 is connected with the pedal second leaf 222 by a hinge 223. The steady connection of the pedal first leaf 221 and the pedal second leaf 222 is realized by the hinge 223, and the relative movement is smooth.

Figure 11:
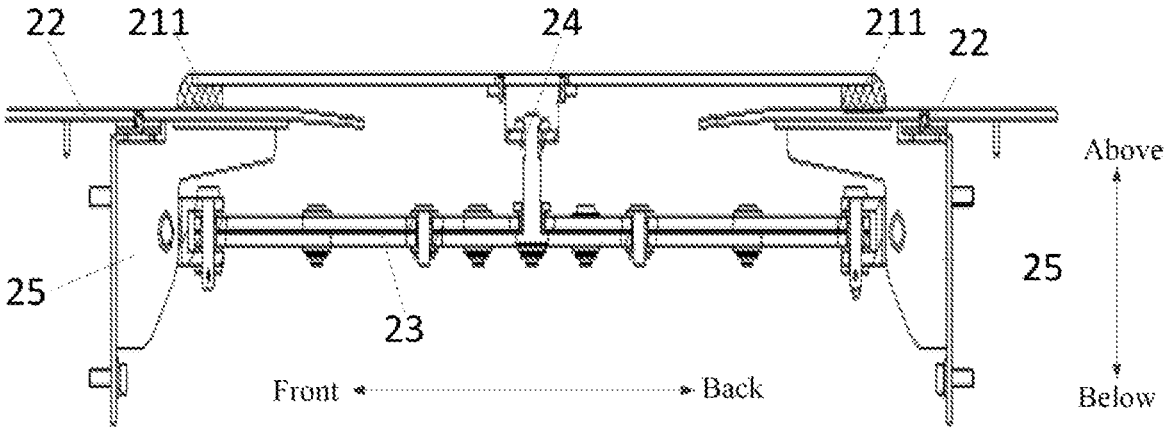
FIG. 11 is a left view of the cab apron assembly shown in FIG. 10.

As shown in FIG. 11, in some embodiments of the present disclosure, cab apron abrasion bars 211 are provided below the front end and the rear end of the cab apron body 21, and the cab apron body 21 is supported on the pedals 22 by the cab apron abrasion bars 211. The cab apron abrasion bars 211 provide buffer, and realize vibration reduction between the cab apron body 21 and the pedals 22, so as to improve the stability of the cab apron assembly 2, and be convenient for the passengers to safely and comfortably pass. Moreover, the cab apron abrasion bars 211 reduce the friction noise and abrasion, and improve the stability of the cab apron assembly 2.

As shown in FIG. 11, in some embodiments of the present disclosure, the train through-passage 100 also includes pedal supports 25. The pedal supports 25 are used for connecting the vehicle ends of the carriages. The front end of the linkage assembly 23 and the pedal 22 located at the front side are connected with the pedal support 25 located at the front side, and the rear end of the linkage assembly 23 and the pedal 22 located at the rear side are connected with the pedal support 25 located at the rear side. The pedal support 25 is capable of realizing steady connection of the pedals 22 and the linkage assembly 23 with the vehicle ends of the vehicle body, so as to improve the stability and safety of the whole cab apron assembly 2.

Figure 12:
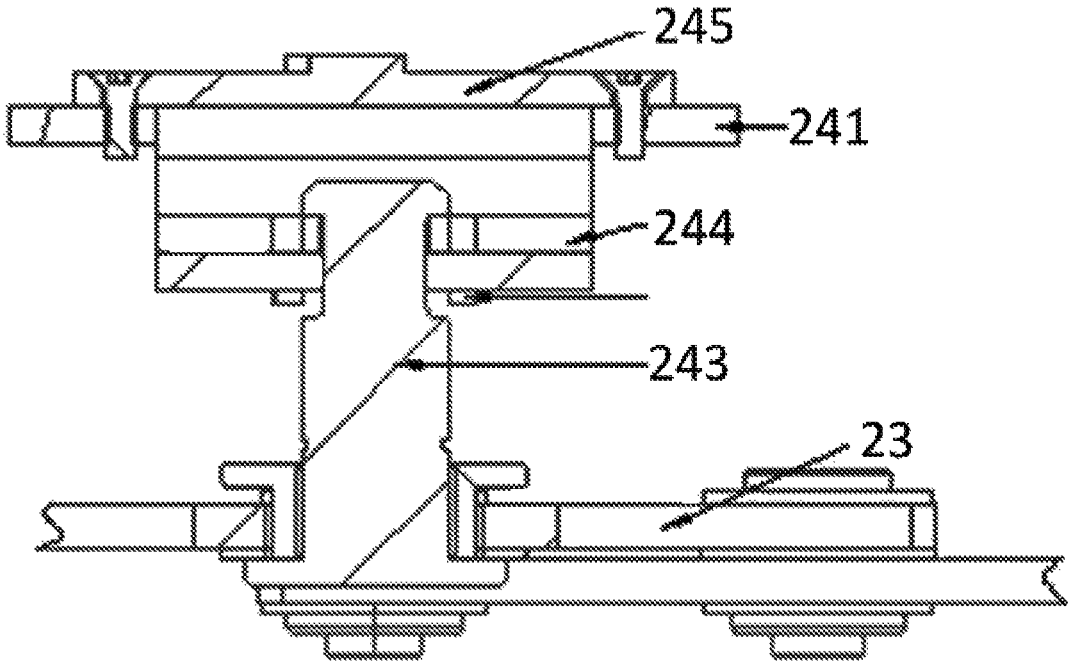
FIG. 12 and FIG. 13 are schematic diagrams of a positioning mechanism of two different embodiments.
Figure 13:
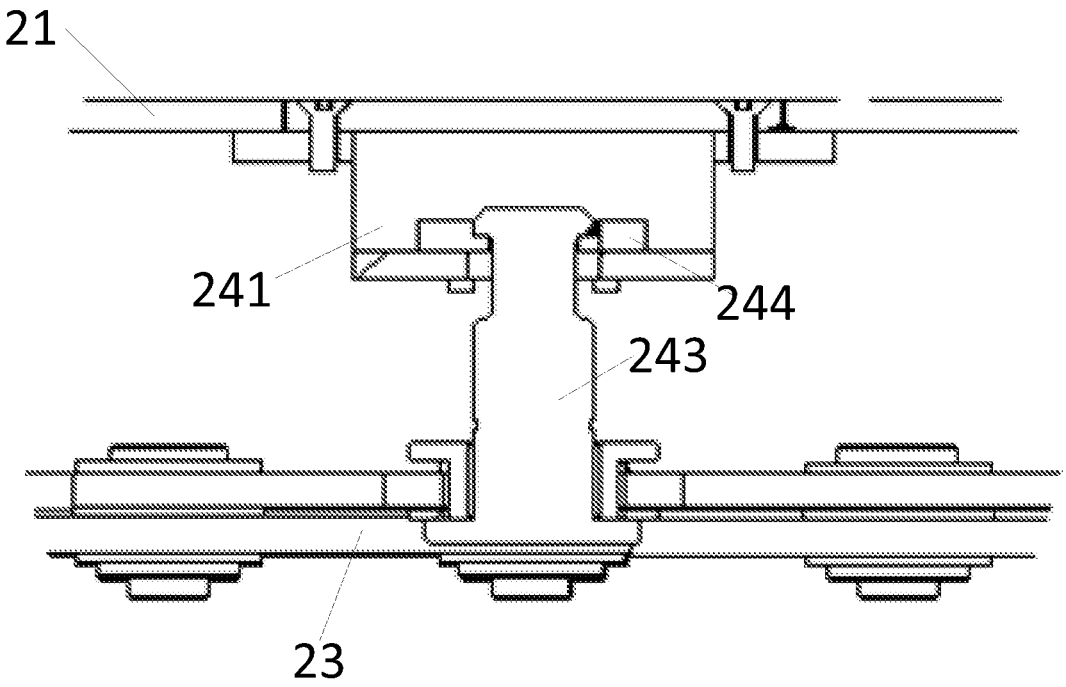

As shown in FIG. 12 and FIG. 13, in some embodiments of the present disclosure, the positioning mechanism 24 includes: a cab apron cover locking plate 241 and a cab apron positioning pin 243. The cab apron cover locking plate 241 is connected with the cab apron body 21; the cab apron positioning pin 243 is connected with the cab apron cover locking plate 241 and a linkage respectively. The positioning mechanism 24 realizes steady connection of the linkage with the cab apron body 21, so as to improve the stability and safety of the cab apron body 21.

Further, as shown in FIG. 12, the upper end of the cab apron positioning pin 243 penetrates through the cab apron cover locking plate 241 and is locked by a cab apron positioning pin locking plate 244, so as to be convenient for the connection of the cab apron positioning pin 243 with the cab apron cover locking plate 241.

Profitably, as shown in FIG. 12, the positioning mechanism 24 also includes a cab apron cover 245, a mounting hole is formed in the cab apron body 21, the cab apron cover 245 is provided in the mounting hole, the cab apron cover 245 is fixedly connected with the cab apron cover locking plate 241, and the upper surface of the cab apron cover 245 is flush with the upper surface of the cab apron body 21. The cab apron cover 245 covers the positioning mechanism 24, so that the appearance of the cab apron assembly 2 is attractive, steady connection of the positioning mechanism 24 with the cab apron body 21 is realized, and the safety and the stability are improved.

Further, as shown in FIG. 12, the cab apron cover locking plate 241 is connected with the cab apron cover 245 by screws.

Moreover, in combination with FIG. 1 to FIG. 13, the present disclosure also provides a train through-passage 100, including the folding-canopy assembly 1 and the cab apron assembly 2. Two folding-canopy assemblies 1 are provided in bilateral symmetry; the cab apron assembly 2 is horizontally deployed below the folding-canopy assembly 1 to form a passage located between the two folding-canopy assemblies 1.

The folding-canopy assembly 1 is the folding-canopy assembly 1 in the above-mentioned embodiment, and the cab apron assembly 2 is also the cab apron assembly 2 in the above-mentioned embodiment.

The U-shaped part 113 of the folding-canopy main body 11 adopts a tooth groove design. Although the effect of enhancing connection of the canopy cloth is achieved, the requirement for processing is increased. And meanwhile, the requirement for the strength of the folding-canopy frame is correspondingly increased. The vehicle end wall frame simultaneously plays a role of connecting the vehicle ends and fixing the canopy cloth, but the mounting and dismounting of the through-passage will be relatively troublesome. In addition, the cab apron locking mechanism locks a linkage lock pin in the locking mechanism by the bolt in the mechanism, the structure is relatively complicated, and the maintenance is relatively troublesome.

Thus, the present disclosure provides some more preferable implementation manners.

The folding-canopy assembly 1 is mainly composed of an outward folding-canopy body 111 folding outwards, an inward folding-canopy body 112, folding-canopy mounting frames 114, a vehicle body 12 and the like. The vehicle frame 12 is fixed on the vehicle end wall by screws, the outward folding-canopy body 111 is fixed to the vehicle frame 12 by a locking mechanism 13, a rubber mat 14 is mounted between the vehicle frame 12 and the folding-canopy mounting frames 114, and the locking mechanism 13 is welded on the vehicle frame 12. As shown in FIG. 3, each fold of the canopy cloth is mounted in a profiled slot of the U-shaped part 113 in a manner of sewing and is fixed in a riveting manner by a riveting hole 101.

A support device 15 with a wear-resisting block is welded at the lower end of the U-shaped part 113 in the middle of the folding-canopy cloth, and the support device 15 is placed on a vehicle coupler to prevent the overlong through-passage from generating deformation with drooping middle. The U-shaped part in the middle of the folding-canopy assembly 1 is welded to a support frame 152, the lower end of the support frame 152 is fixed to the wear-resisting block 154 together by a bolt, a fixed block on the wear-resisting plate 153 on the vehicle coupler support plays a limiting role, and the wear-resisting block 154 is in contact with the wear-resisting plate 153 to prevent abrasion to the support frame in the moving process.

The cab apron assembly 2 is mainly composed of the cab apron body 21, the linkage assembly 23, the pedals 22 and the like. The cab apron body 21 is connected to the vehicle end by two same sets of positioning mechanisms 24 and linkage assemblies 23. The positioning mechanism 24 and the linkage assembly 23 are both positioned at the lower side of the cab apron body 21, and cab apron abrasion bars 211 are mounted on the cab apron body 21 and used for absorbing shock and resisting wear between the pedals 22 and the cab apron body 21. The two pedals 22 are respectively located at the front end and the rear end of the cab apron body 21, the pedal first leaf 221 and the pedal second leaf 222 are connected by a hinge 223 and are mounted on a pedal support 25, which is mounted on the vehicle end of the carriage. The cab apron abrasion bars 211 are mounted on the cab apron body 21, and after the cab apron body 21 contacts the pedals 22 on the vehicle end and moves to generate friction, the cab apron abrasion bars 211 play role of absorbing shock and resisting wear.

The positioning mechanism 24 includes the cab apron body 21, the cab apron cover 245, the cab apron cover locking plate 241, the cab apron positioning pin 243, the cab apron positioning pin locking plate 244 and the linkage assembly 23, where a cab apron positioning pin mounting hole is formed in the cab apron body 21 to be convenient for mounting a cab apron positioning structure, and the cab apron positioning pin locking plate 244 and the cab apron cover locking plate 241 are mounted at the lower side of the mounting hole; the cab apron body 21 is connected with the linkage assembly 23 through the cab apron cover locking plate 241, the cab apron positioning pin locking plate 244 and the cab apron positioning pin 243, and is connected to the vehicle end by the linkage assembly 23. Moreover, the cab apron positioning structure is also provided with the cab apron cover 245, which plays the role of shielding the positioning structure and beautifying.

The locking mechanism 13 of the vehicle frame 12 and the folding-canopy main body 11 is replaced by selecting different locking and positioning structures. The same effect is achieved by changing the mounting position of a positioning lock catch in a locking mechanism support and the form of the lock catch, which all fall within the scope of claims of the patent. As for the cab apron structure, the same effect is still achieved by changing the connecting manner of the positioning pin locking plate on the cab apron positioning mechanism, and adopting other mounting manners for the locking plate.

As for the folding-canopy main body 11, connection of each fold of the canopy cloth is realized by adopting a manner of combining a U-shaped frame and rivets, a canopy cloth frame is connected with the vehicle frame by the locking mechanism, so as to realize rapid unlocking, and thus convenience, rapidness and low cost are achieved. A more simplified cab apron positioning structure is formed on the cab apron, and thus attractiveness is enhanced and cost is reduced.

The vehicle frame 12 and the vehicle end wall of the train through-passage 100 according to the embodiment of the present disclosure are connected by screws. Screw holes are formed in the vehicle frame 12 to be used for connecting the vehicle frame 12 with the vehicle end wall. The rubber mat 14 is put into the vehicle frame 12. Malposition design is adopted for the folding-canopy mounting frames 114, and in match with the vehicle frame 12, mounting and compressing are facilitated. When the folding-canopy mounting frames 114 are mounted, at least part of the folding-canopy mounting frames 114 is put into the vehicle frame 12 according to malposition design, so that mounting and positioning are better. The rubber mat 14 is additionally provided between the vehicle frame 12 and the folding-canopy mounting frame 114 during mounting, and after the locking mechanism 13 compresses the folding-canopy mounting frames 114, the folding-canopy mounting frames 114 are in interference fit with the rubber mat 14.

Partial bent design is adopted for the front end of the locking mechanism 13, so that the folding-canopy mounting frames 114 are conveniently compressed. The locking mechanism 13 is welded and fixed to the locking bolts 134. The bolt 132 is rotatably mounted on the mounting bracket 131 by connection with screws. The locking bolts 134 are fixed on the mounting bracket 131 through positioning pins, and the mounting bracket 131 is welded on the vehicle frame 12. When the locking mechanism 13 is in the locking state, the limiting part 133 is moved to be buckled on the bolt 132 to position the bolt 132, and thus mounting, tight contact, good fixing effect, low manufacture cost, and simpleness and reliability are realized.

The connecting manner of the vehicle frame 12 and the vehicle end adopts other fixing manners or substitute the original scheme without affecting the effect of rapidly mounting structures. The bent design of the front end of the bolt 132 is not limited to the bending method as shown in the drawings, and the effect is realized by adopting bending of other shapes as long as the transition requirement for compressing the folding-canopy frame is met. The shape and the mounting position of the positioning lock catch are adjusted and altered, which are all included in the scope of the claims of the patent.

According to the folding-canopy main body, the folding-canopy assembly and the train through-passage provided by present disclosure, a bent locking block design is adopted, so that the compressing operation in the mounting process is conveniently conducted. Due to the adoption of the malposition folding-canopy frame design, mounting is facilitated, and materials are saved. The method of the lock catch is adopted to position the locking state of the locking mechanism.

The cab apron assembly 2 is structurally characterized in that the cab apron assembly 2 is mainly composed of the cab apron body 21, the linkage assembly 23, the pedals 22 and the like. The cab apron assembly 2 is mounted at the joint of two carriages, so that a passenger safely walks to the other carriage from one carriage. The cab apron body 21 is connected to the vehicle end through two same sets of positioning mechanism 24 and linkage assembly 23. The positioning mechanism 24 and the linkage assembly 23 are both located at the lower side of the cab apron body 21. The cab apron abrasion bars 211 are mounted on the cab apron body 21 to be used for absorbing shock and resisting wear between the pedals 22 and the cab apron body 21. The two pedals 22 are respectively located at the front end and the rear end of the cab apron body 21. The pedal first leaf 221 and the pedal second leaf 222 are connected by the hinge 223, and are respectively mounted on the pedal support 25, which is mounted at the vehicle end of the carriage.

Further, the cab apron abrasion bars 211 are mounted on the cab apron body 21, and after the cab apron body 21 contacts the pedals 22 on the vehicle end and moves to generate friction, the cab apron abrasion bars 211 play the role of absorbing shock and resisting wear.

Further, the linkage assembly 23 is composed of multiple linkages, has very strong scalability, and is capable of meeting the requirements of stretching and reducing vehicle end distance of the train in various working conditions. The linkage assembly 23 is mounted in match with the cab apron body 21 and the pedals 22, so that the passing safety and the comfort of passengers are guaranteed.

Further, the cab apron positioning pin locking plate 244 locks a cab apron cotterway through two same locking plates. A counterbore is formed in the cab apron positioning pin 243, which is fixed on the cab apron cover locking plate 241 in a screw connecting manner, so that the purpose of locking the cab apron positioning pin 243 is achieved.

Specifically, the cab apron cover 245 is mounted in a manner of connection by a sunk screw by the cab apron cover locking plate 241. After the mounting is completed, the cab apron body 21 and the cab apron cover 245 are located on the same plane. The skid resistant lines are matched with one another. And the cab apron cover is arranged in order to shield the positioning mechanism at the lower side and enable the cab apron to be attractive in appearance.

According to the folding-canopy main body, the folding-canopy assembly and the train through-passage provided by the present disclosure, brand new design is made to the cab apron positioning structure, the structure is simple, the mounting is convenient, and the manufacture cost is low. The cab apron is more reliable after being mounted, is remarkable in economic benefits, and is especially applicable to the field of rail train through-passages such as monorail and light rail or subway.

Moreover, the mounting hole in the cab apron body 21 is canceled. A spring locking mechanism is added for the cab apron cover locking plate 241. The mechanism is composed of a spring and a locking block to replace the cab apron positioning pin locking plate in the original structure. The positioning pin is locked by the spring locking mechanism, so as to position the cab apron.

The structure of the cab apron assembly 2 is still composed of the cab apron body 21, the linkage assembly 23, the pedals 22 and the like. The cab apron assembly 2 is mounted at the joint of two carriages, so that a passenger safely walks to the other carriage from one carriage. The cab apron assembly 2 is connected to the vehicle end by two same sets of positioning mechanisms 24 and linkage assemblies 23. The positioning mechanism 24 and the linkage assembly 23 are both positioned at the lower side of the cab apron body 21, and cab apron abrasion bars 211 are mounted on the cab apron body 21 and used for absorbing shock and resisting wear between the pedals 22 and the cab apron body 21. The two pedals 22 are respectively provided at the front end and the rear end of the cab apron body 21, the pedal first leaf 221 and the pedal second leaf 222 are connected by the hinge 223 and are mounted on the pedal support 25, which is mounted on the vehicle end of the carriage.

According to the folding-canopy main body, the folding-canopy assembly and the train through-passage provided by the present disclosure, the locking structure is simplified, and by adopting the manner of the cab apron positioning mechanism, the structure is optimized, and the production cost is saved.

In the description of the present disclosure, it should be understood that, orientations or position relationships indicated by terms such as "center", "longitudinal", "transverse", "length", "width", "thickness", "up", "down", "front", "back", "left", "right", "vertical", "horizontal", "top", "bottom", "inner", "outer", "clockwise", "counterclockwise", "axial", "radial", and "circumferential" are orientations or position relationship shown based on the accompanying drawings, and are merely used for describing the present disclosure and simplifying the description, rather than indicating or implying that the apparatus or element should have a particular orientation or be constructed and operated in a particular orientation, and therefore, should not be construed as a limitation on the present disclosure.

In addition, terms "first" and "second" are used only for description purposes, and shall not be understood as indicating or suggesting relative importance or implicitly indicating a quantity of indicated technical features. Therefore, features defined by "first" and "second" may explicitly or implicitly include at least one feature. In the description of the present disclosure, unless otherwise specifically limited, "multiple" means at least two, for example, two or three.

In the present disclosure, it should be noted that unless otherwise clearly specified and limited, the terms "mounted", "connected", "connection", and "fixed" should be understood in a broad sense. For example, a connection may be a fixed connection, a detachable connection, or an integral connection; may be a mechanical connection or an electrical connection; may be a direct connection or an indirect connection by means of an intermediate medium; or may be internal communication between two elements or interaction relationship between two elements, unless otherwise clearly limited. A person of ordinary skill in the art may understand specific meanings of the terms in the present disclosure according to specific situations.

In the present disclosure, unless otherwise clearly specified and limited, that a first feature is "above" or "below" a second feature may be that the first and the second features are in contact with each other directly, or the first and the second features are in contact with each other indirectly by using an intermediate medium. Moreover, that the first feature is "above", "over", and "on" the second feature may be that the first feature is right above the second feature or at an inclined top of the second feature, or may merely indicate that the horizontal height of the first feature is higher than that of the second feature. That the first feature is "below", "under", and "beneath" the second feature may be that the first feature is right below the second feature or at an inclined bottom of the second feature, or may merely indicate that the horizontal height of the first feature is lower than that of the second feature.

In the description of the specification, the description made with reference to terms such as "one embodiment", "some embodiments", "example", "specific example", or "some examples" means that a specific characteristic, structure, material or feature described with reference to the embodiment or example is included in at least one embodiment or example of the present disclosure. In this specification, exemplary descriptions of the foregoing terms do not necessarily refer to a same embodiment or example. In addition, the described specific features, structures, materials, or characteristics may be combined in a proper manner in any one or more of the embodiments or examples. In addition, a person skilled in the art may integrate or combine different embodiments or examples and characteristics of different embodiments or examples described in the specification, as long as they do not conflict each other.

Although the embodiments of the present disclosure are shown and described above, it can be understood that, the foregoing embodiments are exemplary, and cannot be construed as a limitation to the present disclosure. Within the scope of the present disclosure, a person of ordinary skill in the art may make changes, modifications, replacement, and variations to the foregoing embodiments.

What is claimed is:

1. A train through-passage, comprising:

two folding-canopy assemblies, wherein the two folding-canopy assemblies are deployed in bilateral symmetry; and a cab apron assembly, wherein the cab apron assembly is horizontally deployed below the folding-canopy assemblies to form a passage located between the two folding-canopy assemblies, wherein each folding-canopy assembly comprises:

a vehicle frame mounted on a vehicle end wall;

a folding-canopy main body including:

an outward folding-canopy body, and an inward folding-canopy body, wherein the inward folding-canopy body is formed by connecting at least two pieces of internal canopy cloth which arch inwards to form a U shape along the front-back direction, the outward folding-canopy body is formed by connecting at least two pieces of external canopy cloth which arch outwards to form a U shape along the front-back direction, end portions of two adjacent pieces of internal canopy cloth and end portions of two adjacent pieces of external canopy cloth are clamped and riveted by U-shaped parts, and a front side and a rear side of the folding-canopy main body are each connected with a folding-canopy mounting frame, and the folding-canopy mounting frames are detachably connected with the vehicle frame; and a locking mechanism including a mounting bracket fixedly mounted on a body of a vehicle, a bolt rotatably disposed on the mounting bracket, and a limiting part for limiting the bolt, wherein the locking mechanism is fixedly mounted on the vehicle frame, and adapted to lock the folding-canopy mounting frames and the vehicle frame together or to release the folding-canopy mounting frames from the vehicle frame, and the locking mechanism is switched between the locking state and the releasing state.

2. The train through-passage according to claim 1, wherein the cab apron assembly comprises:

a cab apron body, wherein the cab apron body is horizontally provided;

two pedals, respectively provided at the front side and the rear side of the cab apron body, wherein the pedals are used for connecting the vehicle ends of carriages and supporting the cab apron body; and a linkage assembly, used for connecting two adjacent carriages, wherein the linkage assembly is deployed along the front-back direction, the front end and the rear end of the linkage assembly are suitable for connecting the vehicle ends of the carriages, and a positioning mechanism connected with the cab apron body is provided on the linkage assembly, wherein the positioning mechanism comprises:

a cab apron cover locking plate, wherein the cab apron cover locking plate is connected with the cab apron body;

a linkage positioning plate, wherein the linkage positioning plate is connected with the cab apron cover locking plate; and a cab apron positioning pin, wherein the cab apron positioning pin is connected with the linkage positioning plate and a linkage respectively.

3. The train through-passage according to claim 2, wherein the pedal comprises:

a pedal first leaf, wherein the pedal first leaf is horizontally provided and supported below a side edge of the cab apron body, and the pedal first leaf is located at an outer side of the side edge of the cab apron body; and a pedal second leaf, wherein the pedal second leaf is horizontally provided and supported below the side edge of the cab apron body, and the pedal second leaf is movably connected with the pedal first leaf.

4. The train through-passage according to claim 3, wherein the pedal first leaf is connected with the pedal second leaf by a hinge.

5. The train through-passage according to claim 2, wherein the train through-passage also comprises:

pedal supports, wherein the pedal supports are used for connecting the vehicle ends of the carriages, the front end of the linkage assembly and the pedal located at the front side are connected with the pedal support located at the front side, and the rear end of the linkage assembly and the pedal located at the rear side are connected with the pedal support located at the rear side.

6. The train through-passage according to claim 2, wherein cab apron abrasion bars are provided below the front end and the rear end of the cab apron body, which is supported on the pedals by the cab apron abrasion bars.

7. The train through-passage according to claim 2, wherein the upper end of the cab apron positioning pin penetrates through the linkage positioning plate and is locked by a cab apron positioning pin locking plate.

8. The train through-passage according to claim 2, wherein the positioning mechanism also comprises a cab apron cover, a mounting hole is formed in the cab apron body, the cab apron cover is provided in the mounting hole, the cab apron cover is fixedly connected with the cab apron cover locking plate, and the upper surface of the cab apron cover is flush with the upper surface of the cab apron body.

9. The train through-passage according to claim 8, wherein the cab apron cover locking plate is connected with the cab apron cover by a screw.

10. The train through-passage according to claim 1, wherein the train through-passage also comprises a support device used for being mounted on a vehicle coupler, and the support device comprises:

a bottom plate, wherein the bottom plate is mounted on the vehicle coupler;

a support frame, wherein the lower end of the support frame is provided with a wear-resisting block and is movably supported on the bottom plate; and wear-resisting plates, wherein the wear-resisting plates are provided on the bottom plate and limit the support frame along the front-back direction, wherein the lower end of at least one U-shaped part in the folding-canopy main body is supported on the support frame.

11. The train through-passage according to claim 10, wherein two wear-resisting plates are deployed in the front and at the behind at an interval, opposite side edges of the two wear-resisting plates are of arc shapes bulging towards opposite directions, and the wear-resisting block extends along the left-right direction and is movably provided between the two wear-resisting plates.

* * * * *